US011345138B2

(12) United States Patent
Benzoni

(10) Patent No.: US 11,345,138 B2
(45) Date of Patent: May 31, 2022

(54) SHEET PROCESSING SYSTEM AND METHOD

(71) Applicant: ENGICO S.R.L., Lissone (IT)

(72) Inventor: Rinaldo Benzoni, Paderno Dugnano (IT)

(73) Assignee: ENGICO S.R.L., Lissone (IT)

( * ) Notice: Subject to any disclaimer, the term of this patent is extended or adjusted under 35 U.S.C. 154(b) by 0 days.

(21) Appl. No.: 16/757,556

(22) PCT Filed: Oct. 12, 2018

(86) PCT No.: PCT/IB2018/057921
§ 371 (c)(1),
(2) Date: Apr. 20, 2020

(87) PCT Pub. No.: WO2019/092520
PCT Pub. Date: May 16, 2019

(65) Prior Publication Data

US 2021/0197544 A1 Jul. 1, 2021

(30) Foreign Application Priority Data

Nov. 9, 2017 (IT) ..... 102017000127604

(51) Int. Cl.
*B41F 13/00* (2006.01)
*B41F 5/02* (2006.01)
(Continued)

(52) U.S. Cl.
CPC ..... *B41F 13/0024* (2013.01); *B41F 5/02* (2013.01); *B41F 5/24* (2013.01); *B41F 13/30* (2013.01);
(Continued)

(58) Field of Classification Search
CPC B41P 2213/42; B41F 13/085; B41F 13/0024; B41F 13/36; B41F 5/02; B41F 5/24; B41F 13/30
See application file for complete search history.

(56) References Cited

FOREIGN PATENT DOCUMENTS

| | | | |
|---|---|---|---|
| EP | 0950521 | A1 | 10/1999 |
| IT | UB20150070 | A1 | 9/2016 |
| IT | UB20150564 | A1 | 9/2016 |

OTHER PUBLICATIONS

Firestone, "Firestone, World's No. 1 Air Spring.", 2013, Firestone, pp. 1-31 (Year: 2013).*

(Continued)

*Primary Examiner* — Leslie J Evanisko
*Assistant Examiner* — Leo T Hinze
(74) *Attorney, Agent, or Firm* — Vorys, Sater, Seymour & Pease

(57) ABSTRACT

A flexographic printing unit is provided for a sheet along a printing line, including a plurality of printing assemblies, each including a printing roller apt to include a printing block, automatic and programmable movement apparatus for the printing rollers, apt to distance at least one of the printing rollers from the printing line during the printing procedure, so that the printing roller does not print the sheet, wherein each of the printing assemblies includes a structure fixed to the floor, at least one frame, which is movable with respect to the structure fixed to the floor, including at least one printing roller and apt to be moved by the displacement apparatus and damping apparatus arranged between the frame and a fixed point so as to damp the movement of the frame.

10 Claims, 8 Drawing Sheets

Figure 1A:
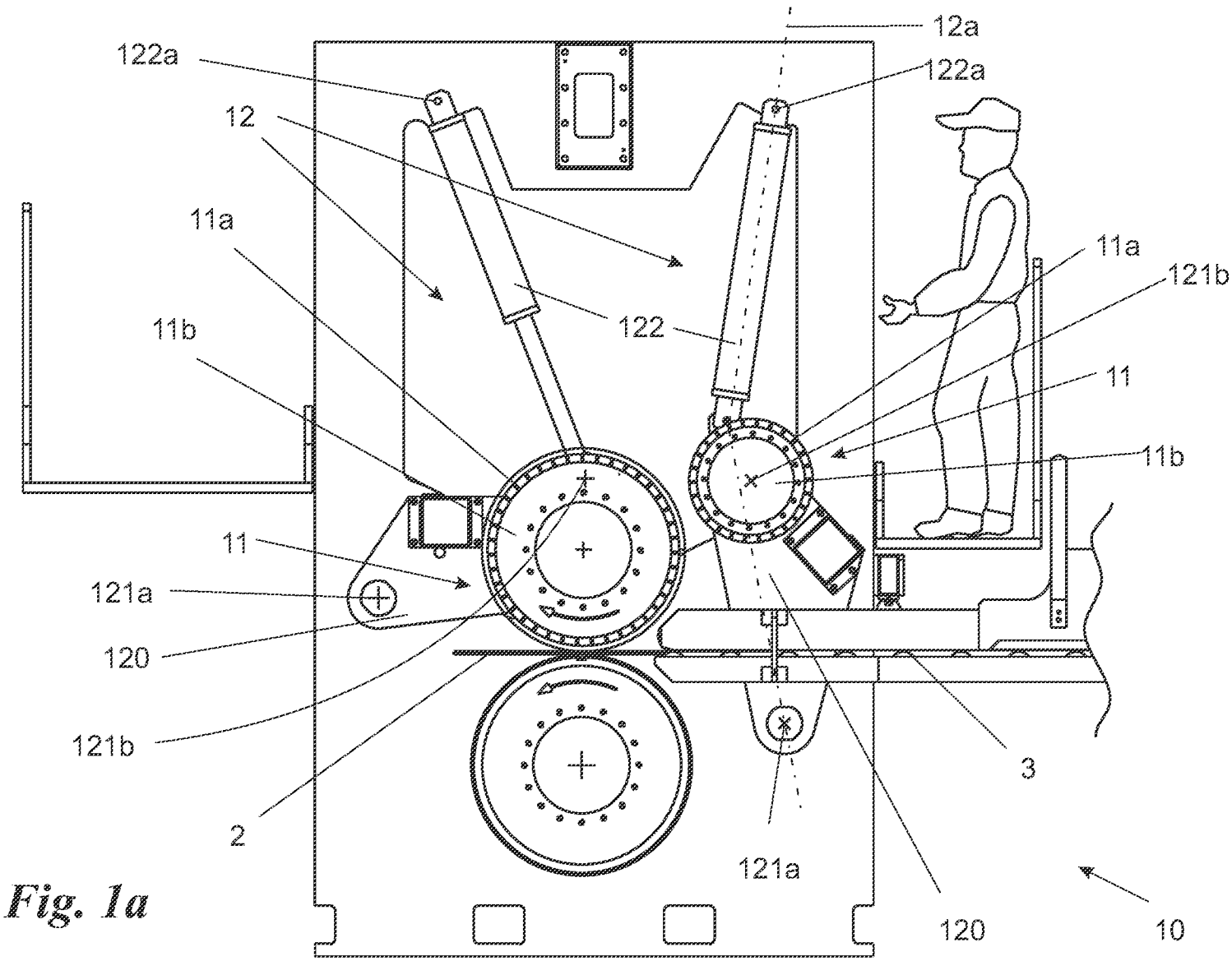

(51) Int. Cl.

| | |
|---|---|
| ***B41F 5/24*** | (2006.01) |
| ***B41F 13/30*** | (2006.01) |
| ***B41F 13/36*** | (2006.01) |
| ***B41F 19/00*** | (2006.01) |
| ***B41F 33/08*** | (2006.01) |

(52) U.S. Cl.
CPC ..... *B41F 13/36* (2013.01); *B41F 19/008* (2013.01); *B41F 33/08* (2013.01); *B41P 2213/42* (2013.01)

(56) References Cited

OTHER PUBLICATIONS

International Search Report and Written Opinion dated Dec. 12, 2018 for PCT/IB2018/057921 to Engico S.R.L. filed Oct. 12, 2018.
Generalmatic S.R.L., "Cilindri Elastici a Semplice Effetto Air Springs—Air Bellows", Jul. 28, 2017, XP002786675, Retrieved from the Internet: URL:http://www.generalmatic.com/ECM31.php [retrieved on Nov. 21, 2018] cited in the application with Machine Translation.
Italian Search Report dated Jul. 16, 2018 for IT 201700127604 to Engico S.R.L, filed Nov. 9, 2017.

* cited by examiner

SHEET PROCESSING SYSTEM AND METHOD

The present invention relates to a sheet processing system of the type described in the preamble of the first claim.

Different types of machines are presently known for processing sheets, in particular of corrugated cardboard for producing boxes, placards and cardboard cut-outs in general.

In detail, the machines generally comprise a feeding unit, apt to provide sheets or strips of cardboard at a given predetermined distance, a printing unit of the flexographic type, apt to print, by means of rollers and printing blocks apt to transfer each a color onto the sheet of cardboard, a die-cutting assembly, comprising a roller, supporting a die-cutter on the surface, apt to cut, crease or define fold or cut lines.

Said rollers and elements are all perfectly aligned and moved simultaneously and at identical speeds to allow a perfect alignment of the crease and cut lines coming from the die-cutting assembly and of the single colors coming from the printing assemblies. For example, the rollers all have one same diameter so that the sheet of cardboard is perfectly carried and printed or cut in a perfectly aligned manner.

The prior art described above comprises some important drawbacks.

In particular, said systems are relatively little flexible and it is impossible to vary the size of the rollers in financially advantageous times.

Therefore, those purchasing a system must choose whether to opt for a system with rollers having smaller diameters or larger diameters.

The rollers with smaller diameters are faster, easier to handle and require less energy to use, but they do not allow sheets of cardboard to be made processed with a greater length with respect to the length of the circumference of the rollers. Rollers with larger diameters are bulkier and more complex to use, but they allow sheets to be processed with greater and not smaller lengths.

Two classical roller circumference lengths are 66 in (1676.4 mm) and 99 in (2514.6 mm).

Furthermore, the systems described by patent applications IT102015000008125 and IT102015000008136 are currently known.

These patents describe, in particular, procedures and systems which allow the preceding drawback to be overcome.

However, an important drawback of the above patents is that, especially with regard to the printing unit, the movement mechanisms of the printing rollers involve travel ranges and extended movements, as well as being poorly controlled. For this reason, the printing step is carried out at a low speed.

Added to this is the fact that the structures of the printing assembly are subjected to considerable wear and the movement means are subjected to significant cyclic loads.

It this situation, the technical task underlying the present invention is to create a sheet processing system, which is substantially able to overcome the stated drawbacks.

In the scope of said technical task, it is an important aim of the invention to obtain a sheet processing system, which is flexible and not very voluminous and also allows sheets of a great length to be processed.

It is a further technical aim to obtain a sheet processing system, which allows the printing speed of the sheets themselves to be increased.

In conclusion, it is a further aim of the invention to reduce the maintenance cycles on the system, reducing wear on the movement mechanisms.

The technical task and specified aims are achieved with a sheet processing system, as claimed in the appended claim 1.

Preferred embodiments are highlighted in the dependent claims.

Figure 1B:
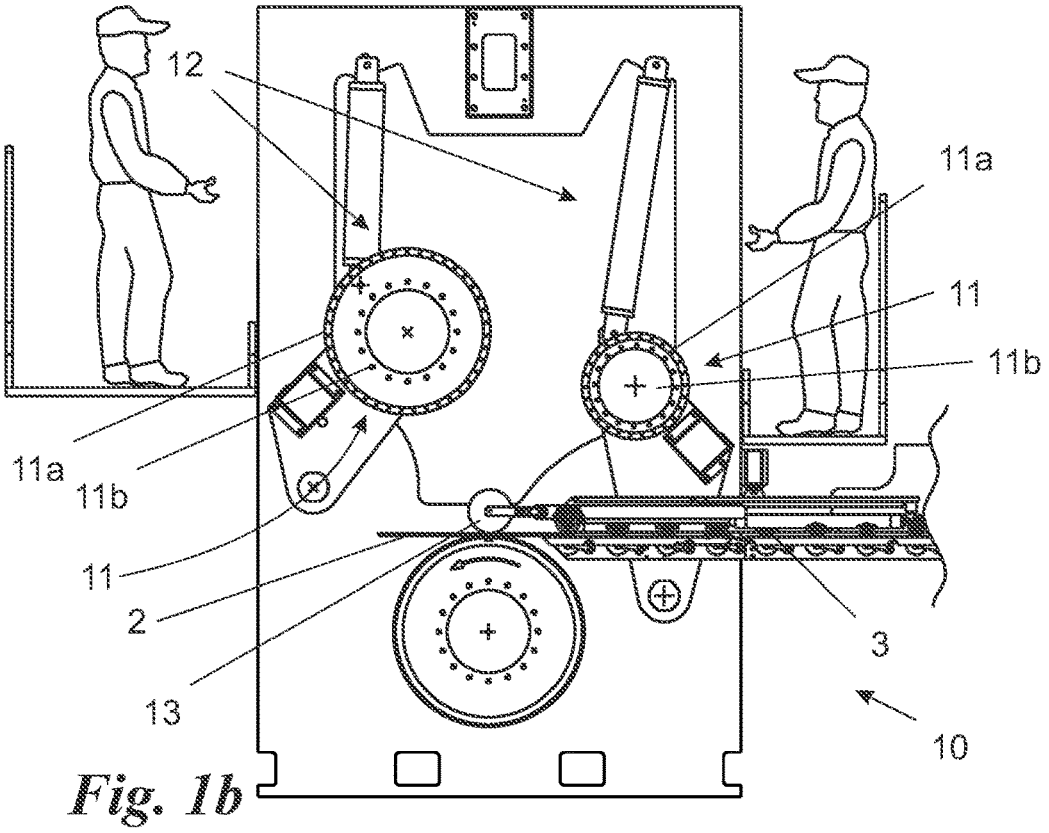
Figure 1C:
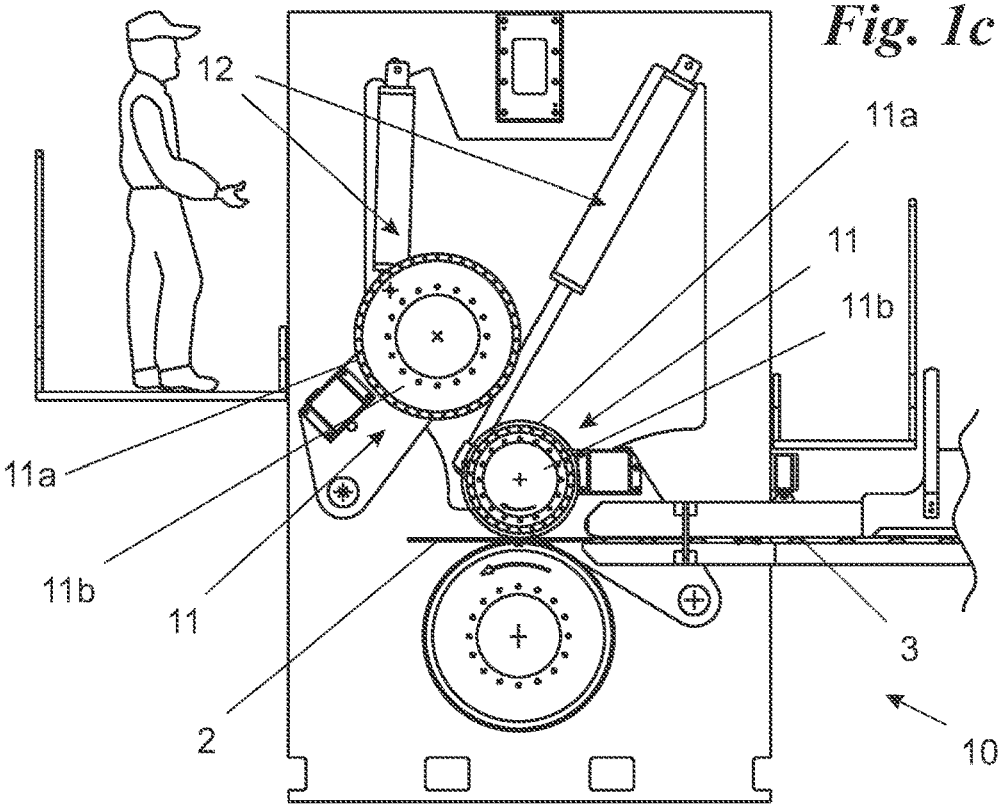
Figure 2A:
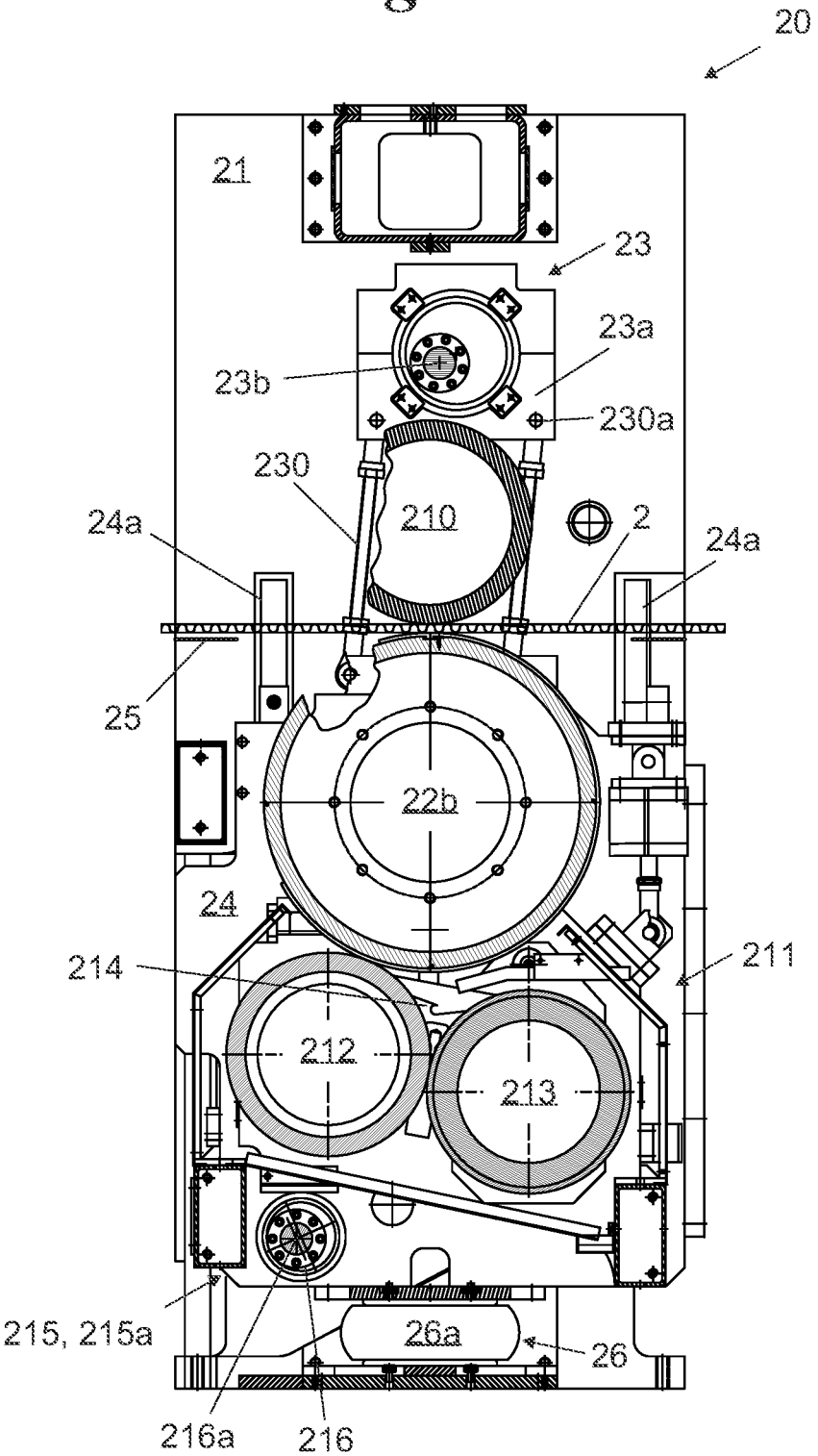
Figure 2B:
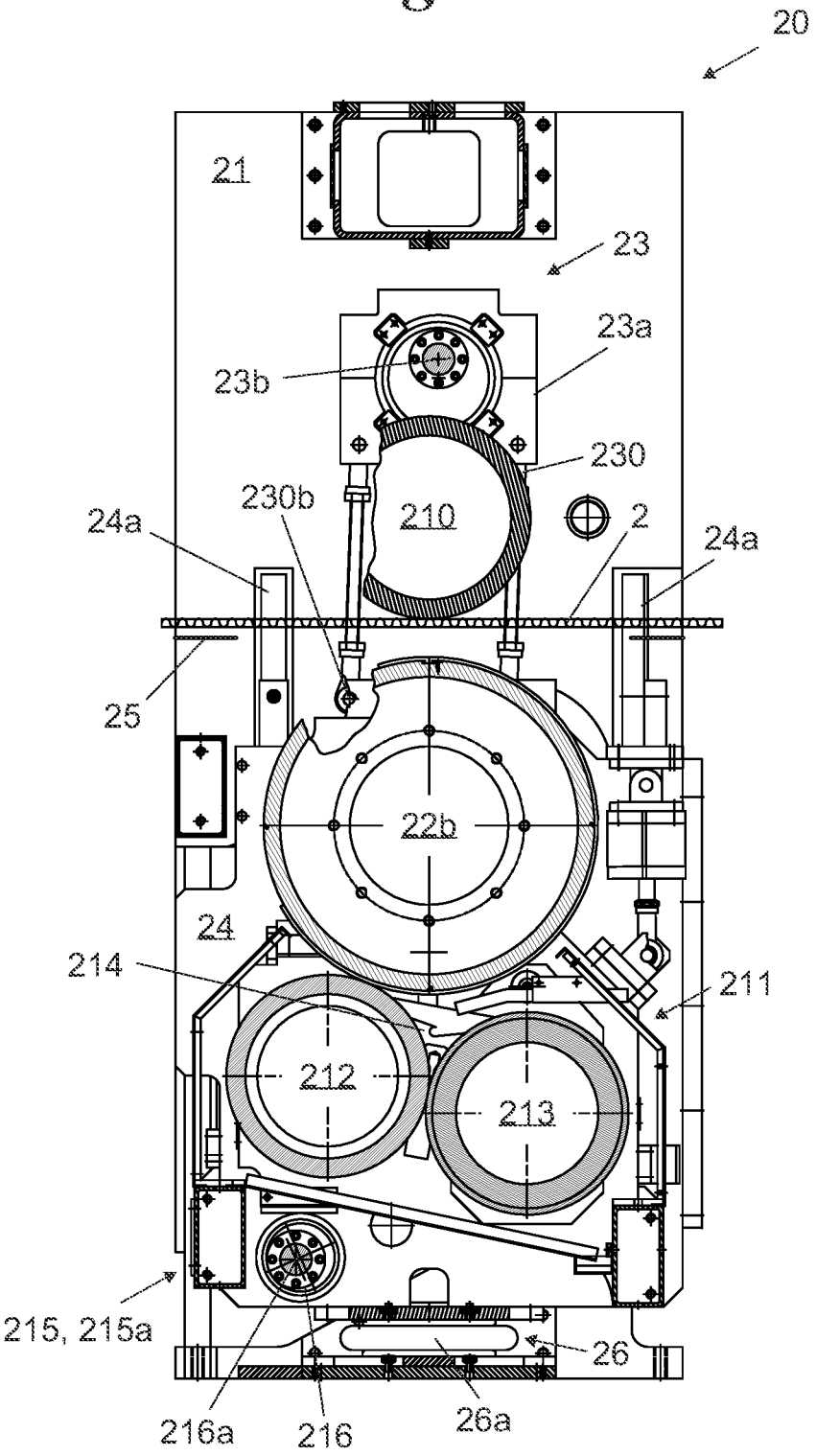
Figure 3A:
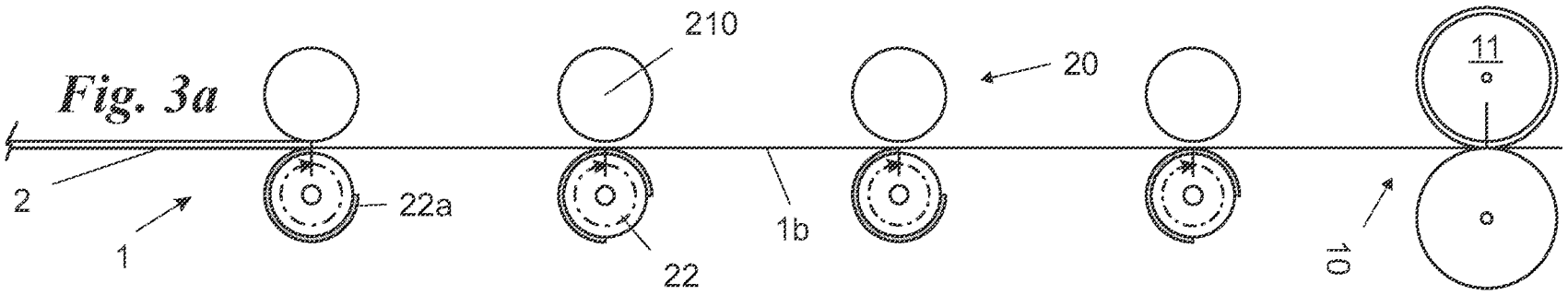
Figure 3B:
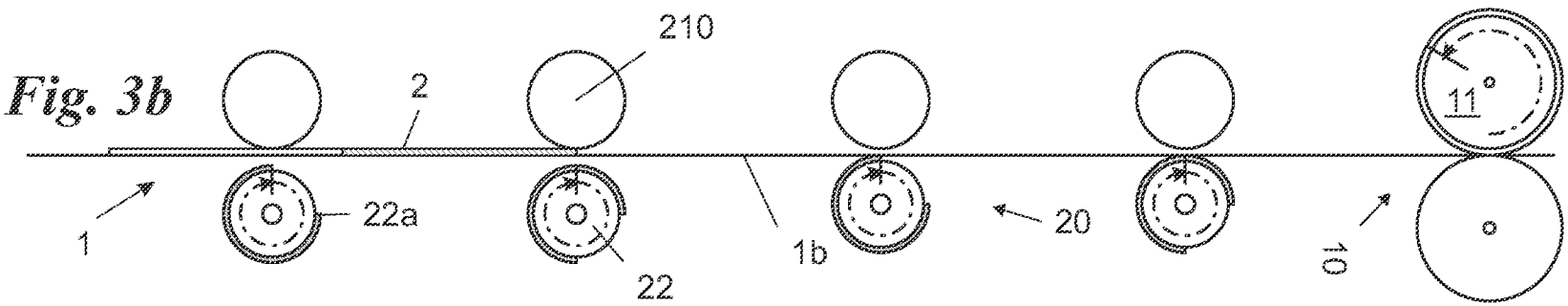
Figure 3C:
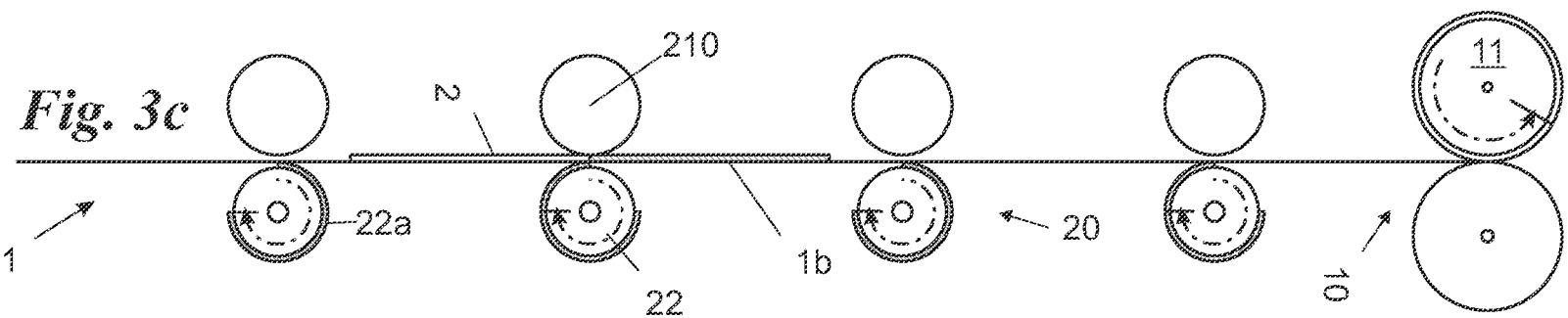
Figure 3D:
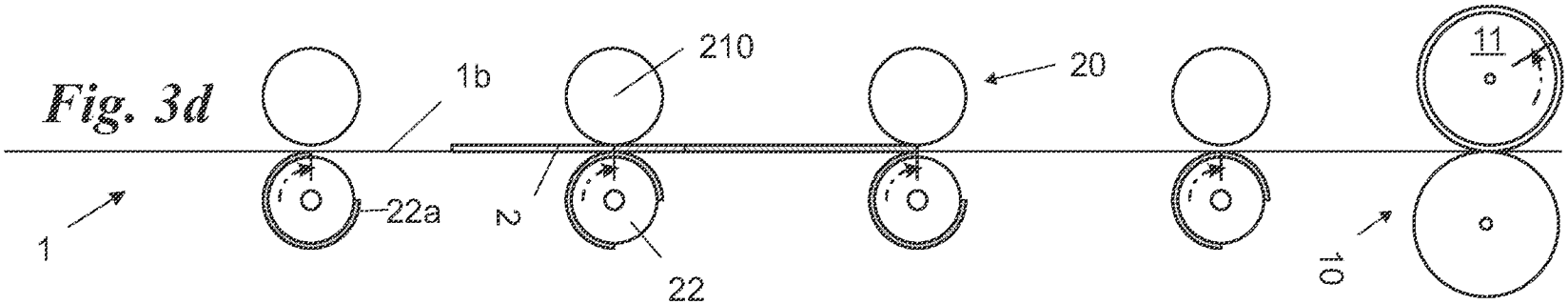
Figure 3E:
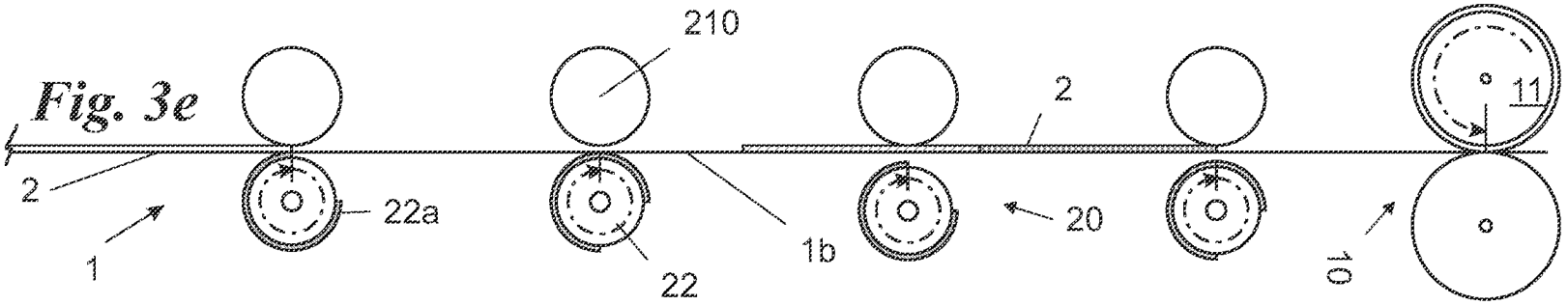
Figure 3F:
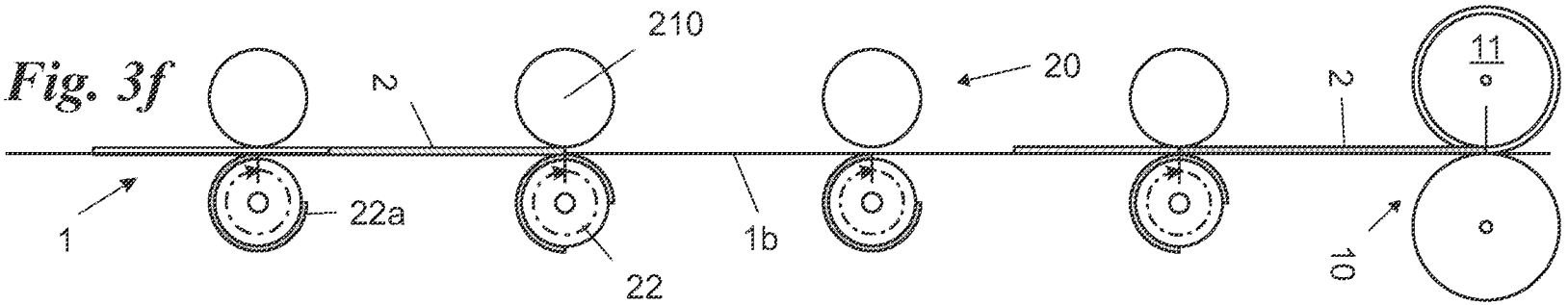
Figure 4A:
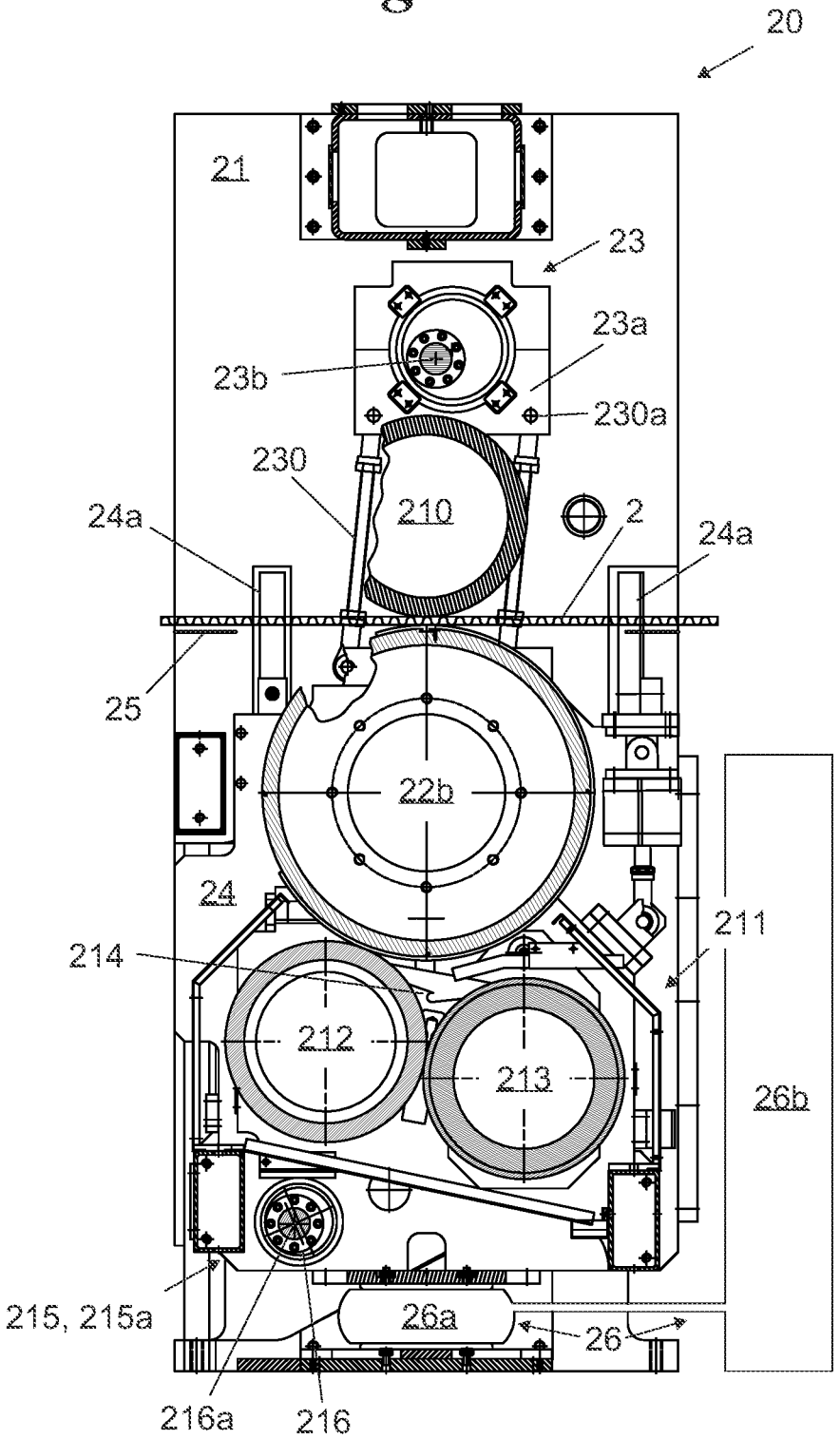
Figure 4B:
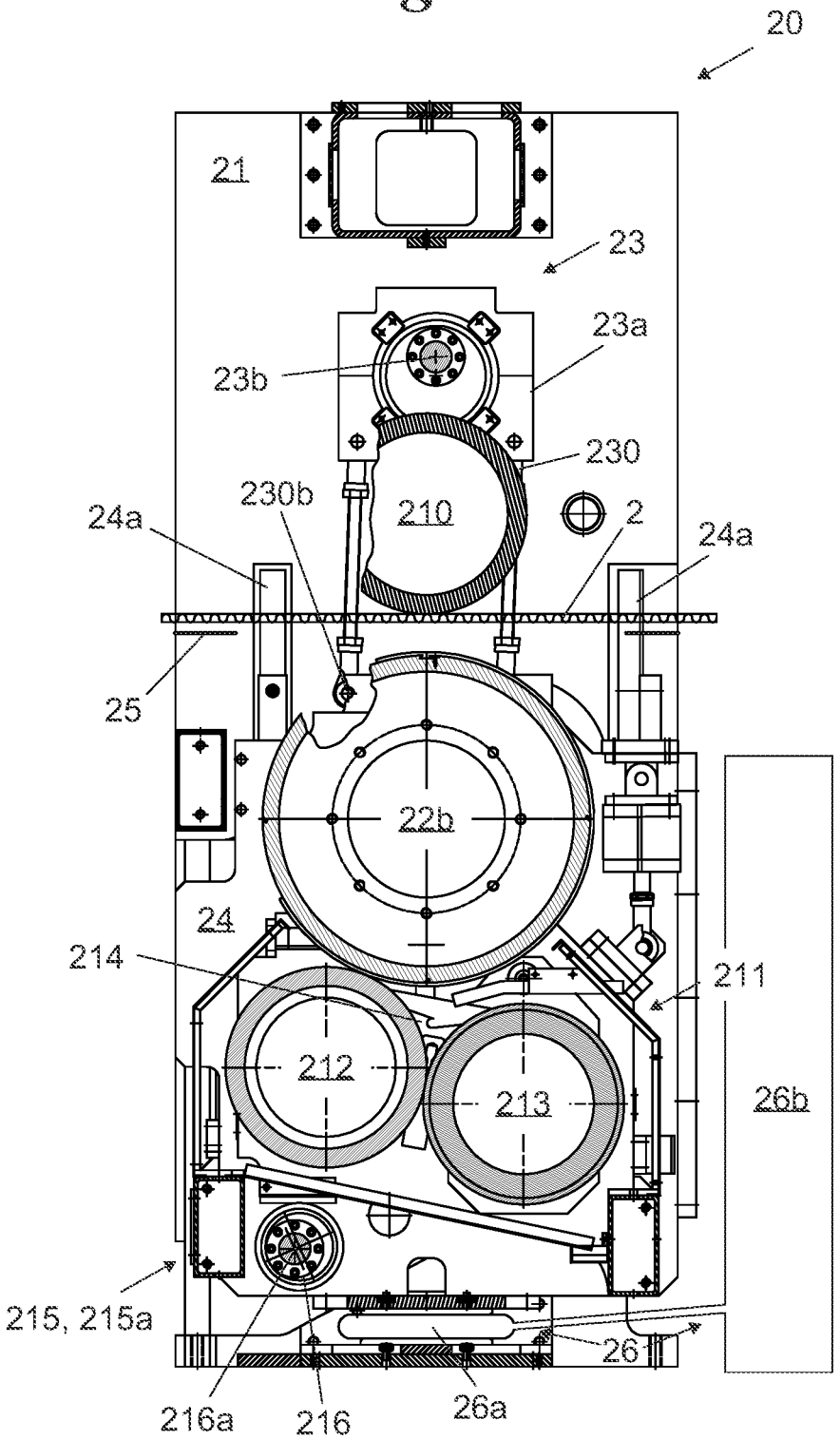

The features and advantages of the invention are clarified below by the detailed description of preferred embodiments of the invention, with reference to the accompanying drawings, wherein:

FIG. 1*a* shows a first portion of the system according to the invention in a first configuration;

FIG. 1*b* shows said first portion of the system according to the invention in a second configuration;

FIG. 1*c* shows said first portion of the system according to the invention in a third configuration;

FIG. 2*a* illustrates a second portion of the system according to the invention in a first configuration;

FIG. 2*b* illustrates the second portion of the system according to the invention in a third configuration;

FIG. 3*a* illustrates a third portion of the system according to the invention in a first configuration;

FIG. 3*b* illustrates the third portion of the system according to the invention in a second configuration;

FIG. 3*c* illustrates the third portion of the system according to the invention in a third configuration;

FIG. 3*d* illustrates the third portion of the system according to the invention in a fourth configuration;

FIG. 3*e* illustrates the third portion of the system according to the invention in a fifth configuration;

FIG. 3*f* illustrates the third portion of the system according to the invention in a sixth configuration;

FIG. 4*a* illustrates a second portion of the system, wherein the damping means include an external storage tank according to the invention in a first configuration; and FIG. 4*b* illustrates the second portion of the system, wherein the damping means include an external storage tank according to the invention in a third configuration.

With reference to the Figures, the system for processing sheets according to the invention is globally indicated with numeral 1.

In particular, it is apt to process sheets 2, or strips, of paper or cardboard, more specifically cardboard, and still more specifically corrugated cardboard.

Preferably, the system 1 comprises a plurality of units, each for implementing a different process or activity. In particular, a die-cutting unit 10 is present, a printing unit 20 of the flexographic type, a unit for inserting the sheets 2 and a unit for the removal or subsequent processing of the sheets 2.

The system 1 defines a processing line 1*b*, which is the line along which the sheet 2 is moved, preferably, the processing line is straight and defines a direction of processing. In the printing unit 20 the processing line coincides with a printing line 1*a*. The direction along the processing line is called longitudinal hereinafter, preferably it is perpendicular to the vertical direction and to a transverse direction which completes the three orthogonal axes. Said processing line is preferably maintained by means of a plurality of coated toothed belts and/or of movement rollers 3.

Preferably, the sheets 2 are moved along the processing line 1*b* at a constant speed. In fact, in terms of energy, it is extremely challenging to speed up or slow down the heavy components of the system 1. Consequently, rollers with different diameters preferably move at identical tangential speeds and at different rotational speeds to one another and inversely proportionate to the diameters.

The unit for inserting the sheets 2 allows the sheets 2 to be inserted into the system at intervals of time comparable with predetermined and preferably constant intervals of space. It is known in itself.

The die-cutting unit 10 is illustrated in FIGS. 1*a*-1*c*. It is apt to die-cut the sheet 2, in other words to make cuts or fold lines or cut lines along the same sheet 2.

It comprises a plurality of die-cutting rollers 11, preferably only two, each apt to include a die-cutter 11*a*. Each die-cutting roller 11 thus comprises a die-carrying roller 111*b* and the die-cutter 11*a*, arranged on the surface of the roller and generally consisting of wooden shells comprising metal sheets and the like, apt to implement said processing.

Furthermore, the die-cutting unit 10 suitably comprises movement means 12 for the die-cutting rollers 11, apt to arrange the die-cutting rollers 11 in a working position, wherein they are apt to die-cut the sheet 2, and in a resting position, wherein they are not active and lie at a distance from the sheet 2 and it is thus possible to operate on the same, for example change the die-cutter 11*a*. The movement means 12 are further apt to move the die-cutting rollers 11 rapidly, independently of one another. Consequently, the rollers can occupy mutually different means and spaces and they can be of different sizes, in particular with different diameters. The term rapidly is understood to mean that the operation is carried out in very short periods of time with respect to the times in which it would be carried out if the die-cutting unit 10 comprised only one roller, constrained to the rest of the unit by means of the traditional constraint means, such as screws and bolts. For example, the changing of the roller in the die-cutting unit 20 can be carried out in a few minutes or even just in a few seconds.

For each die-cutting roller 11, the movement means 12 comprise a first movement arm 120 having ends firmly constrained to a first hinge 121*a*, and to a second hinge 121*b*.

The first hinge 121*a* is placed at a distance from the die-cutting roller 11 and, in particular, at a distance from the center of the roller 11, in the plane perpendicular to the transverse direction, greater than the diameter of the roller 11.

The second hinge 121*b* is preferably placed close to the die-cutting roller 11 and at a distance from the center of the roller itself and preferably close to the surface thereof.

Preferably, for each die-cutting roller 11, the movement means 12 comprise a three-hinged arch 12*a* with an extendible arm. It comprises said first and said second hinge 121*a* and 121*b* and said first arm 120. Each three-hinged arch 12*a* comprises a second arm 122 connected by means of a third hinge 122*a*, preferably fixed to the structure of the die-cutting unit 10 and positioned in a vertically upper, spaced apart position, in particular at a distance greater than the diameter of the roller 11 from the center of the die-cutting roller 11. The second arm 122 is also a fluid dynamic, preferably hydraulic, cylinder or an electric linear actuator, apt to move the three-hinged arch 12*a* and consequently the movement means 12 and the roller 11.

Said structure enables an ideal and selectable movement by means of an appropriate choice of the position of the hinges of the rollers 11, so that the same do not interfere reciprocally.

Finally, it can comprise guides apt to support the rollers, in particular during the movement thereof.

Furthermore, the working position is appropriately interposed between the first hinges 121*a*, so it is in the middle with respect to the resting positions of the two die-cutting rollers 11.

The die-cutting unit 10 further comprises an accompanying roller 13, which is preferably movable by means of a telescopic rod or the like. The accompanying roller 13 is apt to arrange itself in said working position, when the die-cutting rollers 11 are both in the resting position (FIG. 1*b*) so as to keep the processing line 1*b* in a resting position, with sheets 2 which are not die-cut.

Advantageously and preferably, the die-cutting rollers 11 have different sizes from each other and appropriately, they have circumferences with such lengths as to have a common divider, and said circumferences can be obtained by dividing each of said lengths by a whole number smaller than 5. Preferably, the common divider must be multiplied by two to obtain the diameter or circumference of a first die-cutting roller 11 and by three to obtain the diameter or circumference of a second die-cutting roller 11. Preferably, the two rollers have circumferences in reciprocal proportions of 2 to 3 for reasons clarified below. Furthermore, the dimensions of the circumferences are preferably 66 in and 99 in.

Preferably, the flexographic printing unit 20 is arranged upstream of the die-cutting unit.

It comprises a plurality of printing assemblies 21, each comprising a printing roller 22 apt to include a printing block 22*a*. The printing roller 22 thus comprises a printing block carrying roller 22*b* and the printing block 22*a*. The printing block 22*a*, known in itself, is a raised surface made of rubber or photopolymeric materials apt to stamp the print directly on the sheet 2.

Advantageously, the printing rollers 22 have different dimensions with respect to at least one of the die-cutting rollers 12, preferably the largest one, and appropriately, they have circumferences with such lengths as to have a common divider and said circumferences can be obtained by dividing each of said lengths by a full number smaller than 5. Preferably, the common divider must be multiplied by two to obtain the diameter or circumference of the printing roller 22 and by three to obtain the diameter or circumference of the second die-cutting roller 11. Substantially, the two rollers have circumferences in reciprocal proportions of 2 to 3 for reasons clarified below. Furthermore, the dimensions of the circumferences are preferably 66 in and 99 in.

Each printing assembly 21 further comprises a counter-pressure roller 210 opposite the printing roller 22, apt to carry the sheet 2 and press the printing roller 22.

The printing assembly then comprises inking means 211 for the printing roller 22. Said inking means 211 preferably comprise a roller, called by convention anilox roller 212 or Anilox, made of steel or ceramic and in contact with the printing roller 22. Preferably, the anilox roller 212 further draws the ink from or with an inking roller 213, also acting as a blade, preferably made of rubber. Preferably, the two rollers are in contact and define a containment zone 214 for the ink between the rollers 212 and 213. Alternatively, a blade system is included, performing the same function and known in itself.

The inking means 211 also comprise limitation means 215 for the ink placed on the printing roller 21. Such limitation can also occur by limiting the ink on the anilox roller 212 or on the inking roller 213. They comprise either distancing means 215*a* for rollers part of the inking means 211, in particular for the anilox roller 212 from the printing roller 22 (FIG. 2*b*) or from the inking roller. In detail, the distancing means 215*a* comprise an eccentric 216 with a fixed axis

216*a* with respect to the printing roller 22, moving a shoulder supporting the anilox 212 and inking 213 rollers. The eccentrics 216 are preferably moved by brushless electric motors.

Advantageously, each printing assembly 21 further comprises automatic, programmable displacement means 23 for said printing rollers 22, apt to distance at least one of the printing rollers 22 from the printing line 1*a* during the printing process, so that the printing roller 22 does not print the sheet 2.

The term automatic is understood to mean that the operation is not carried out manually, but by means of special devices, and the term programmable is understood to mean that the printing moment can be selected from the control means of the printing unit 20.

Preferably, the displacement means 23 are apt to move each single said printing roller 22 individually and independently of the others.

Preferably, the displacement means 23 move a plurality of rollers simultaneously, in particular the printing roller 22, the anilox roller 212 and the inking roller 213. They can operate with any kind of means, for example, endless screws, fluid dynamic cylinders and others.

In a preferred embodiment, they operate with two eccentrics 23*a*, which are opposite and aligned in a transverse direction with the rotation axis 23*b* parallel to the transverse direction.

The eccentrics 23*a* are thus movably constrained to a frame 24.

The frame 24 is thus apt to be moved by the displacement means 23.

More specifically, the frame 24 is apt to be moved at least downwards and at least upwards by means of the eccentrics 23*a* at least with respect to the vertical direction.

The frame 24 is preferably a movable frame with respect to a fixed structure included in each printing assembly 21, bearing at least the printing roller 22. Preferably, the frame 24 also supports other rollers 212 and 213. Furthermore, the frame 24 is preferably movably constrained to at least one guide 24*a*.

More appropriately, the frame 24 is movably constrained to two guides 24*a*.

The guide 24*a* or the guides 24*a* are preferably apt to allow the frame 24 to move exclusively along the vertical direction.

Furthermore, the eccentrics 23*a* have a rotation axis constrained to the structure fixed to the floor of the printing assembly 21 and they are preferably moved by brushless electric motors.

In detail, the eccentrics 23*a* are movably constrained to the frame 24 by means of at least one bar 230.

Said bar 230 is preferably a rigid bar and defines two connection points with the eccentric 23*a* and the frame 24 respectively.

The two connection points consist of a fourth hinge 230*a* and a fifth hinge 230*b*.

The fourth hinge 230*a* preferably consists of an unstable constraint between the eccentric 23*a* and the bar 230. Instead, the fifth hinge 230*b* preferably consists of an unstable constraint between the bar 230 and the frame 24.

More appropriately, each eccentric 23*a* is movably constrained to the frame 24 by means of two bars 230.

Therefore, the eccentrics 23*a*, comprising the bars 230 apt to transmit the movement of the eccentrics 23*a* aligned with the frame 24 (in detail, preferably by means of the fourth and fifth hinge 230*a*, 230*b*), the frame 24 and the guides 24*a* preferably define a crank-handle mechanism.

Each printing assembly 21 preferably comprises damping means 26.

The damping means 26 are preferably elastically deformable means adapted to deform upon compression.

Preferably, the damping means 26 are arranged between the frame 24 and a fixed point so as to damp the movement of the frame 24.

The fixed point can thus be a portion of the fixed structure or, for example, the floor or any other fixed point, such as other external structures.

More appropriately, the damping means 26 are arranged between the frame 24 and the floor, along said vertical direction, so as to damp the movement of the frame 24 along the vertical direction.

Preferably, the damping means 26 comprise a pneumatic cylinder 26*a*. The pneumatic cylinder 26*a* is known in itself and of the elastic type, for example, with simple effect, commonly known as Air Spring or Air Bellow. Similar cylinders are marketed by the company Generalmatic s.r.l. and described on web page: http://www.generalmatic.com/ECM31.php.

However, the damping means 26 could comprise other components, such as electromechanical or hydraulic dampers or, again, elastomeric elements apt to absorb the loads of the frame 24, deforming and giving rise to hysteresis cycles repeated depending on the movements imposed by the eccentrics 23*a*.

Consequently, the damping means 26 preferably consist of dampers for the previous crank-handle mechanism.

In detail, the damping means 26 are apt to damp and absorb the loads caused by the descending movement of the frame 24 and facilitate and push the movement of the frame 24 upwards along the vertical direction.

Preferably, the damping means 26 make a passive actuator when they push the movement of the frame. In fact, when the pneumatic cylinder 26*a* is allowed to return to the non-deformed configuration, it exerts a force in a vertical direction, apt to lift the frame 24.

Furthermore, preferably, the damping means 26 also include at least one storage tank 26*b*.

The storage tank 26*b* could be comprised inside the unit or external. Preferably, it is external so that its volume does not affect the dimensions of the unit.

Furthermore, preferably, the storage tank 26*b* is in fluid passage communication with the pneumatic cylinder 26*a*. In particular, they are connected in such a way that, when the pneumatic cylinder 26*a* is deformed, the variation in overall volume of the damping means 26 including the pneumatic fluid is less than 20%. Appropriately, the variation in overall volume is preferably less than 10%. Even more appropriately, the variation in overall volume is less than 5%.

In particular, this latter aspect allows the operating pressure of the damping means 26 to be kept substantially constant during the whole activity and, in particular, during the damping and suspension steps.

The connection between the storage tank 26*b* and the pneumatic cylinder 26*a* is preferably always open during the operational steps.

It is important to note that the step in which the frame 24 moves downwards coincides with the distancing of the printing roller 22 from the sheet 2. Vice versa, in the lifting step of the frame 24, the printing roller 22 approaches the sheet 2 as shown in FIGS. 2*a* and 2*b*. Consequently, each distancing and approaching movement of the printing rollers 22 with respect to the sheet 2, which is carried out by the movement means 23 through the frame 24, is damped by means of the damping means 26.

The displacement means 23 can also be coupled to support means 25, such as rollers or rods for the sheet in the absence of the printing roller (FIG. 2*b*).

Finally, the successive processing or extraction unit for the processed sheets 2 is of a known type.

The invention comprises a new processing procedure for the sheet 2 and, in particular, a new printing procedure.

Such procedure is preferably carried out by means of the described processing system 1 for the sheet 2 and, in particular, by means of the described printing unit 20.

In such procedure, which is carried out along the processing 1*b* and printing 1*a* lines, a sheet is inserted having a length, in the direction of the printing line 1*a*, which is greater than the circumference of two printing rollers 22, and preferably smaller or equal to the size of the circumference of the die-cutting roller 11 with larger diameter.

In said procedure, during printing, at least one of the printing rollers 22 prints only one part of the sheet 2 and is distanced from the printing line 1*a*, so as not to print the whole sheet 2 and so as not to repeat the print of the motif of the printing block thereof on the sheet 2. By means of said procedure, it is thus possible to print sheets 2 having a greater length than the diameter of the printing roller 22 with non-periodic motifs and positioned in any position on the sheet 2, also at one end. Furthermore, preferably, several printing rollers 22, preferably two, are synchronized with respect to the position on the sheet 2, so that a plurality of printing rollers 22 print different and complementary portions of the sheet 2 for a printed surface length, in the direction of the printing line 1*a*, which is greater than the circumference of the printing rollers 22 and preferably equal to the length of the sheet 2, so that the printing rollers 22 can print up to the whole length of the sheet 2, preferably with the same ink color.

More specifically, the printing rollers 22 are divided internally into groups, synchronized with respect to the position on the sheet 2, so that each assembly of printing rollers prints a single color. For example, in FIGS. 3*a*-3*f* four printing rollers 22 are shown, synchronized two by two and apt to print two colors overall. Synchronization preferably takes place on adjoining printing rollers 22, but it can also take place in an alternate manner, in other words, the first synchronized with the third and the second with the fourth.

Clearly, in the present document, the term "synchronized with respect to the position on the sheet 2" or simply "synchronized" does not mean the classical synchronization of the rollers, which each traditional printing machine needs, for example, when each roller prints a single color, but the particular synchronization described and illustrated.

Preferably, said processing procedure for the sheet 2 also comprises the die-cutting of the sheet 2, preferably by means of the described die-cutting unit 10 having and using a die-cutting roller 11 with a circumference whose length is greater, equal or smaller than the length of the sheet 2 and also consequently, greater than the length of the circumferences of the printing rollers 22 and having, with the same, the described proportion between the circumference lengths, in other words, having a common divider, which can be obtained by dividing each of said lengths by a full number smaller than 5, as described previously. The length of the sheet 2 is also preferably smaller than the double of the circumference of the printing rollers 22.

Consequently, the die-cutting roller 11 is apt to die-cut, if necessary, the whole sheet 2, while the printing rollers 22 are apt to print up to the whole sheet 2 because they are synchronized with respect to the position on the sheet 2, as described previously.

Furthermore, the die-cutting roller 11 and the printing rollers 22 are preferably initially synchronized in the same printing position, so that the circumferential imbalance between the rollers is equal to, or a module of, the distance between rollers and so that the printing positions are aligned. They also revert to being synchronized in such position after a number of turns equal to the highest of the full numbers which are obtained by dividing the circumferences of the rollers 11 and 22 by said common divider.

Furthermore again, the sheets are inserted by the sheet 2 insertion unit, preferably at constant intervals of time, which, the advancing speed along the processing line 1*b* being constant, correspond to constant and predetermined distances. Said distances are preferably equal to the diameter of the printing rollers 22, more preferably equal to 66 in.

The operation of the processing system 1 described in structural terms and in terms of innovative procedural solutions is detailed below and examples thereof are also defined.

In the examples below, to simplify the presentation and illustration, in FIGS. 3*a*-3*f*, the rollers 22 and 11 are aligned in one same angular position and have identical distances to the circumference thereof. However, it is clear that such reciprocal identical distance can be replaced by correct and synchronized angular positions.

In said figures, an arrow placed at the top indicates the advancing direction and course of the cardboard during the processing.

In a first example, without die-cutting and in one only color, the system must print the first half of a sheet 2 having a length greater than the distance between the printing rollers 22 and the circumference thereof. For example, the roller is 66 in and the sheet 99 in.

In such case, only one roller 22 is sufficient, thus other rollers 22 are distanced from the printing line 1*a* by the displacement means 23. Said roller 22 used has a printing block 22*a* with a length of 49.5 in, thus equal to ¾ of the circumference of the printing roller 22. The sheet 22 is thus inserted so that the first edge of the sheet 2 in a longitudinal direction, reaches the start of the printing block 22*a*. On rotating, the printing block is thus printed on the sheet 2 and, when it reaches the end, the displacement means 23 distance the roller 22 from the printing line, so that the same is not printed again on the end portion of the sheet 2.

In a second example, without die-cutting and in two colors, the system must print the whole sheet 2 having a length greater than the circumference of the printing rollers 22, in this example equal to the reciprocal distance thereof. For example, the roller is 66 in and the sheet 99 in.

In this case, four printing rollers are needed, two per color. Such case is, except for the die-cutting part, not present in this example, illustrated in FIGS. 3*a*-3*f*.

Each color is divided into two consecutive printing rollers 22, each bearing half of the total portion to be printed, and therefore a printing block of 49.5 in, thus equal to ¾ of the circumference of the printing roller 22.

In the initial position, all of the rollers are synchronized (FIG. 3*a*) with the position 0°, represented by a vertical line on the figures, facing upwards and the printing blocks 22*a* of the first and third roller 22, which cover the angular positions from 0 to ¾ of a round angle, and the printing blocks 22*a* of the second and fourth roller 22, which cover the angular positions from ½ to ¼ of a round angle, or rather the whole of the circumference, except for the angular segment between ¼ of a round angle and ½ of the round angle.

The sheet 2 is thus inserted so that the first edge of the sheet 2, in a longitudinal direction, reaches the start of the printing block 22*a* (FIG. 3*a*). On rotating, the printing block 22*a* of the first roller 22 thus prints on the sheet 2 and, when it reaches the end, the displacement means 23 distance the roller 22 from the printing line, so that the same does not print on the end portion of the sheet 2 again.

The sheet 2 consequently reaches the printing block 22*a* of the second roller 22 (FIG. 3*b*) and the beginning of the sheet 2 is always aligned with the 0° position of the second roller 22, since the rollers and the sheet rotate and advance at the same tangential and linear speed and cover the same distance.

Thus, when the sheet 2 reaches the printing block 22*a* of the second roller 22, the latter is distanced from the printing line 1*a* by the movement means 23. In fact, the first half of the sheet 2 is already printed by the first roller 22*a*.

The sheet 2 advances and the roller 22 rotates and when the latter covers ¾ of the circumference (FIG. 3*c*), which correspond to 49.5 in, the sheet 2 covers the same 49.5 in, which correspond to half the length thereof.

The sheet 2 thus faces the non-printed half thereof, the second half, at the beginning of the printing block 22*a*, in other words in the angular position equal to ½ of a round angle.

In this case, too, on rotating the roller 22 prints on the sheet 2 as far as the end of the sheet 22, the first color is thus completely printed.

Furthermore, in the meantime, the rollers 22 terminate a fourth of a turn, which separates them from the end of the second turn (FIG. 3*d*) and the sheet 2 reaches the beginning of the third roller 22, for which the 0° position is aligned at the beginning of the sheet 2. Thus, the third roller starts to print the second color starting from the beginning of the sheet 2, while the second roller is finishing the print of the first color. At the same time, thus after two turns of the rollers 22, the second sheet 2 can be inserted.

Thus, the printing of the second color proceeds in the same way as the printing of the first color.

In a third example, the system must print in two colors and die-cut the whole sheet 2 with a length greater than the circumference of the printing rollers 22. For example, the roller is 66 in and the sheet 99 in. Thus, the die-cutting roller 11 with a selected diameter is initially placed in a working position.

Furthermore, in this case, four printing rollers 22 are needed, two per color and a 99 in die-cutting roller 11 to die-cut the whole sheet 2. Such case is illustrated precisely in FIGS. 3*a*-3*f*.

Each color is divided into two consecutive printing rollers 22, each bearing half of the total portion to be printed, and thus a 49.5 in printing block, therefore equal to ¾ of the circumference of the printing roller 22.

This example is identical to the one previously presented, with the only difference that, after the printing of the second color (FIGS. 3*e* and 3*f*) the sheet 2 reaches the beginning of the die-cutting roller 11 and is die-cut thereby along the whole length.

In particular, the first edge of the sheet 2 in a longitudinal direction, reaches the beginning of the die-cutter 11*a* (FIG. 3*f*). On rotating, the die-cutter 11*a* of the roller 11 die-cuts the sheet 2 in a substantially traditional manner.

The processing system 1 according to the invention achieves important advantages.

In fact, the system 1 is extremely flexible and allows sheets with a length greater than the length of the circumference of the printing rollers, or also sheets with a reduced length to be processed, in particular, printed and die-cut. In particular, the same system can process 66 in and 99 in sheets.

Furthermore, the processing system 1, and, in particular each printing assembly 21, comprises a movement mechanism, which significantly reduces wear and volume and increases the control of the printing roller 22. In fact, the loads caused by the frame 24 and by the movement thereof are damped by the damping means 26, which act both as a damper and as accompanying means in the step of lifting the frame 24 by the movement means 23 according to the mechanisms described in the document.

The damping means 26, together with the mechanism consisting of a frame 24, movement means 23 and a guide 24*a*, allow the printing speed of the sheets 2 to be increased in the printing unit 20. In particular, with respect to what is known at the current state of the art, it is even possible to increase the printing speed by 3 or 4 times. The fact of using external storage tanks 26*b* can allow extremely efficient damping means 26 to be made, wherein, for example, the maximum fluctuation pressure is around 0.5 bars.

In this way, excellent operating efficiency is guaranteed with a considerable increase in the reactivity of the unit during the movement of the frame 24, with the pneumatic cylinder 26*a* acting as a passive actuator.

The invention is subject to variations falling within the scope of the inventive concept defined by the claims. In such scope, all details can be replaced by equivalent elements and any materials, shapes and sizes can be used.

The invention claimed is:

1. A flexographic printing unit, for a sheet along a printing line, defining a vertical direction, perpendicular to said printing line and comprising a plurality of printing assemblies, each comprising a printing roller apt to include a printing block, automatic, programmable displacement means for said printing rollers, apt to distance at least one of said printing rollers from said printing line during a printing process, so that said printing roller does not print said sheet, each of said printing assemblies comprising:

a structure fixed to a floor, at least one frame, which is movable with respect to said structure fixed to the floor, comprising said at least one printing roller and apt to be moved by said displacement means, said displacement means comprising eccentrics for said printing rollers, apt to modify the position of said printing rollers and apt to move said frame at least downwards and at least upwards with respect to said vertical direction, each of said printing assemblies comprising at least one guide, said frame being movably constrained to said at least one guide and said at least one guide being apt to exclusively allow a movement along said vertical direction of said frame with respect to said structure fixed to the floor, each of said printing assemblies further comprising damping means arranged between said frame and a fixed point so as to damp and push the movement of said frame, making a passive actuator when said damping means push the movement of said frame.

2. The flexographic printing unit according to claim 1, wherein said damping means comprise a pneumatic cylinder and a storage tank external to said flexographic printing unit and in fluid passage connection with said pneumatic cylinder so that, when said pneumatic cylinder is deformed, the variation in overall volume of said damping means including a pneumatic fluid is less than 20%.

3. The flexographic printing unit according to claim 1, wherein each of said printing assemblies comprises at least one bar movably constraining said frame and said eccentric and apt to transmit the movement of said eccentrics to said frame, and said eccentrics, said frame and said at least one guide defining a crank-handle mechanism.

4. The flexographic printing unit according to claim 1, wherein said fixed point is selected between a fixed point of said fixed structure and the floor and said damping means are arranged between said frame and a point fixed along said vertical direction so as to damp the movement of said frame along said vertical direction.

5. A method for printing a sheet along a printing line by means of a flexographic printing unit, comprising moving said sheet along a direction of said printing line through said flexographic printing unit, wherein said flexographic printing unit defines a vertical direction, perpendicular to said printing line and comprises a plurality of printing assemblies, each comprising:

a printing roller apt to include a printing block, wherein said sheet has a length, in the direction of said printing line, which is greater than the length of the circumference of said printing rollers, a structure fixed to a floor, at least one frame, which is movable with respect to said structure fixed to the floor and comprising said at least one printing roller, displacement means movably constrained to said at least one frame and distancing, by means of said frame, at least one of said printing rollers from said printing line, so that said printing roller does not print said sheet, at least one of said printing rollers printing part of said sheet and being distanced from said printing line, so as not to print the whole of said sheet and so as not to repeat the print of a motif of said printing block thereof on said sheet, said displacement means, comprising eccentrics for said printing rollers, modifying the position of said printing rollers and moving said frame at least downwards and at least upwards with respect to said vertical direction, each of said printing assemblies comprising at least one guide, said frame being movably constrained to said at least one guide and said at least one guide exclusively allowing a movement along said vertical direction of said frame with respect to said structure fixed to the floor, and damping and pushing the movement of said frame with damping means of said flexographic printing unit arranged between said frame and a fixed point, and carrying out each of distancing and approaching movements of said printing rollers with respect to said sheet by said displacement means of said flexographic printing unit and said damping means through said frame and damped by said damping means, making a passive actuator when said damping means push the movement of said frame.

6. The method according to claim 5, wherein said damping means comprise a pneumatic cylinder and a storage tank external to said unit and in fluid passage connection with said pneumatic cylinder so that, when said pneumatic cylinder is deformed, the variation in overall volume of said damping means including a pneumatic fluid is less than 20%.

7. The method according to claim 6, wherein said printing rollers are synchronized with respect to a position on said sheet, so that a plurality of said printing rollers print different and complementary portions of said sheet for a length of printed surface, in the direction of said printing line, which is greater than said length of said circumference of said printing rollers.

8. The method according to claim 5, wherein said printing rollers print the whole length of said sheet.

9. A method for processing a sheet along a processing line, comprising a printing procedure according to claim 5, for said sheet, wherein said processing line coincides with said printing line, said printing procedure comprising a die-cutting of said sheet by means of a die-cutting unit comprising at least one die-cutting roller comprising a die-cutter, said die-cutting roller having a circumference with a length greater or equal to said length of said sheet, said die-cutting roller and said printing rollers having circumferences with lengths having a common divider, which can be obtained by dividing each of said lengths by a full number smaller than 5.

10. The method according to claim 9, wherein said damping means comprise a pneumatic cylinder and a storage tank external to said unit and in fluid passage connection with said pneumatic cylinder so that, when said pneumatic cylinder is deformed, the variation in overall volume of said damping means including the pneumatic fluid is less than 20%.

* * * * *